US006670316B2

(12) United States Patent
Sidoti et al.

(10) Patent No.: US 6,670,316 B2
(45) **Date of Patent: *Dec. 30, 2003**

(54) SPOT PRETREATMENT COMPOSITIONS

(75) Inventors: Anthony Domenic Sidoti, Highland Mills, NY (US); Kathleen Elizabeth Landy, Montvale, NJ (US); Frederic Taraschi, Skillman, NJ (US)

(73) Assignee: Reckitt Benckiser Inc., Wayne, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 190 days.

(21) Appl. No.: 09/349,300

(22) Filed: Jul. 7, 1999

(65) Prior Publication Data

US 2003/0008795 A1 Jan. 9, 2003

(30) Foreign Application Priority Data

Jul. 16, 1998 (GB) ..... 9815419

(51) Int. Cl.[7] ..... C11D 1/00; D06L 1/00

(52) U.S. Cl. ..... 510/283; 510/363; 510/403; 510/505; 510/471; 510/475; 510/470

(58) Field of Search ..... 510/283, 363, 510/403, 505, 471, 475, 470

(56) References Cited

U.S. PATENT DOCUMENTS

| | | | | | |
|---|---|---|---|---|---|
| 4,405,483 | A | * | 9/1983 | Kuzel et al. | 510/341 |
| 4,532,066 | A | | 7/1985 | Paszek et al. | 252/144 |
| 4,581,161 | A | * | 4/1986 | Nedonchelle | 510/424 |
| 4,648,987 | A | | 3/1987 | Smith et al. | 252/559 |
| 4,855,069 | A | | 8/1989 | Schuppiser et al. | 252/87 |
| 5,269,960 | A | * | 12/1993 | Gray et al. | 510/303 |
| 5,464,552 | A | * | 11/1995 | Peterson et al. | 510/303 |
| 5,490,948 | A | * | 2/1996 | Klier et al. | 252/122 |
| 5,510,047 | A | * | 4/1996 | Gabriel et al. | 252/89.1 |
| 5,510,052 | A | | 4/1996 | McCandlish | 252/174.12 |
| 5,587,356 | A | * | 12/1996 | Dauderman et al. | 510/320 |
| 5,820,637 | A | * | 10/1998 | Bory et al. | 8/137 |
| 5,853,430 | A | * | 12/1998 | Shindo et al. | 8/137 |
| 5,912,220 | A | * | 6/1999 | Sramek et al. | 510/284 |
| 5,925,608 | A | * | 7/1999 | Spruyt et al. | 510/276 |
| 5,962,388 | A | * | 10/1999 | Sherry et al. | 510/238 |
| 6,010,994 | A | * | 1/2000 | Choy et al. | 510/312 |
| 6,046,152 | A | * | 4/2000 | Vinson et al. | 510/428 |
| 6,051,541 | A | * | 4/2000 | Neuser et al. | 510/337 |
| 6,211,124 | B1 | * | 4/2001 | Ormerod, IV et al. | 510/108 |

FOREIGN PATENT DOCUMENTS

| | | | |
|---|---|---|---|
| WO | WO96/07723 | 3/1996 | C11D/3/386 |
| WO | WO97/45510 | 12/1997 | C11D/1/02 |

OTHER PUBLICATIONS

Copy of GB Search Report for GB Application No. 9916492.3 dated Oct. 8, 1999.

* cited by examiner

*Primary Examiner*—Cynthia H. Kelly
*Assistant Examiner*—Dawn Garrett
(74) *Attorney, Agent, or Firm*—Fish & Richardson P.C.

(57) ABSTRACT

Thickened aqueous cleaning compositions are used for spot cleaning of stains and soils on garments and textiles. The compositions comprise: a detersive surfactant component, preferably anionic and/or nonionic; an organic solvent; an enzyme; and xanthan gum as a thickener.

26 Claims, No Drawings

SPOT PRETREATMENT COMPOSITIONS

The present invention is directed to improved spot cleaning compositions particularly useful for the localized cleaning of stains from garments and textiles.

The prior art has suggested many types of spot cleaning compositions which are intended to be used in the localized cleaning of stains on garments or textiles. Such spot cleaning is typically shortly performed prior to a subsequent laundering step wherein the garment or textiles are immersed in an aqueous bath.

The performance of these spot cleaning compositions is known to vary considerably, based on the types of stains which are to be removed, as well as on the type of textile from which a garment is made. Frequently, while known spot cleaning compositions are effective for many types of stains, they are not necessarily effective in the removal of a test soil, 'bandy black clay' which is notoriously difficult to remove.

A further shortcoming of many known art spot cleaning compositions is that they frequently need to be specifically formulated, or reformulated, for use in a specific class of container or dispensing device. Thus, a manufacturer of such a product may need to simultaneously produce several different formulations of one product, which is inconvenient and costly.

The present invention addresses and overcomes many of these shortcomings known in the prior art.

In a first aspect of the invention there is provided a thickened, aqueous cleaning composition which is particularly useful in the spot cleaning of stains and soils on garments and textiles which comprises:

- a detersive surfactant selected from anionic, nonionic, cationic, amphoteric and zwitterionic surfactants as well as mixtures thereof, preferably at least one nonionic surfactant;
- an organic solvent, preferably selected from alcohols, diols, glycols, glycol ethers, $C_6$–$C_{18}$ methyl ester as well as N-methyl-2-pyrrolidone;
- an enzyme constituent, preferably one which includes proteases;
- a xanthan gum as the primary thickener constituent.

The compositions may optionally, but in some cases desirably include one or more further constituents including but not limited to: pH adjusting agents, pH buffering agents, chelating agents, hydrotropes, perfumes, perfume carriers, fluorescing agents, optical brighteners, colorants such as dyes, hydrotropes, enzyme stabilizers, builders, germicides, fungicides, preservative constituents, anti-oxidants, anti-corrosion agents, antistatic agents as well as other conventional additives known to the relevant art.

These compositions specifically do not include acrylate based thickeners such as those marketed under the tradenames CARBOPOL®, or ACCUSOL®, or clay based thickeners such as laponites.

The compositions of the invention desirably exhibit a relatively low viscosity under high shear conditions, and conversely, exhibit relatively high viscosity under low shear conditions. Such behavior ensures that the compositions may be used in both hand pumpable trigger spray dispensers, and in nozzled dispensers. In the former, high shear conditions exist at the pump, low shear conditions exist at the nozzle. The advantageous viscosity characteristics permit for the same formulation to be used in both of these types of dispensers, which are popularly used with this type of consumer product.

In a further aspect of the invention there is provided a process for the localized cleaning, viz., "spot cleaning" of a soiled or stained garment or textile which process contemplates the application to the soil or stained area of a cleaning effective amount of the compositions described herein. Desirably, such spot cleaning is carried out just prior to a subsequent laundering step.

The inventive compositions include one or more detersive surfactants selected from anionic, nonionic, cationic, amphoteric and zwitterionic surfactants and mixtures thereof.

Exemplary useful anionic surfactants include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Further exemplary anionic surface active agents which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Particularly useful anionic surface active agents, also known as anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain. Especially valuable are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Particularly useful alkyl sulfate anionic surfactants useful in forming the compositions of the invention are alkyl sulfates of the formula

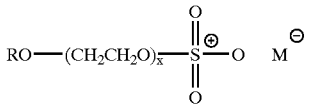

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the non-ethoxylated C12–15 primary and secondary alkyl sulfates.

Exemplary commercially available alkyl sulfates include one or more of those available under the tradename RHODAPON® from Rhône-Poulenc Co. (Cherry Hill, N.J.) as well as STEPANOL® from Stepan Chemical Co. (Northfield, Ill.). Exemplary alkyl sulfates which is preferred for use is a sodium lauryl sulfate surfactant presently commercially available as RHODAPON® LCP from Rhône-Poulenc Co., as well as a further sodium lauryl sulfate surfactant composition which is presently commercially available as STEPANOL® WAC from Stepan Chemical Co.

Particularly preferred alkyl sulfonate anionic surfactants useful in forming the compositions of the present invention are alkyl sulfonates according to the formula

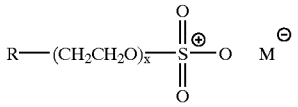

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the $C_{12-15}$ primary and secondary alkyl sulfates.

Exemplary, commercially available alkane sulfonate surfactants include one or more of those available under the tradename HOSTAPUR® from Hoechst Celanese. An exemplary alkane sulfonate which is preferred for use is a secondary sodium alkane sulfonate surfactant presently commercially available as HOSTAPUR® SAS from Hoechst Celanese.

Other anionic surface active agents not particularly enumerated here may also find use in conjunction with the compounds of the present invention.

Further useful detersive surfactants include amine oxides. One general class of useful amine oxides include alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl, dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide.

A further class of useful amine oxides include alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and Additional useful amine oxides include those which may be referred to as alkylmorpholine oxides in which the alkyl group has about 10–20, and preferably 12–16 carbon atoms, and can be straight or branched chain, saturated or unsaturated.

Further examples of such useful include nonionic surfactant compositions based on amine oxides include those which are presently commercially available and include those under the trade name AMMONYX® (ex. Stepan Co.)

Examples of particularly useful amine oxides include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide.

Further useful nonionic surfactants which my be included in the present inventive compositions include nonionic surfactants in which the major portion of the molecule is made up of block polymeric C2–C4 alkylene oxides, with alkylene oxide blocks containing C3 to C4 alkylene oxides. Such nonionic surfactants, while preferably built up from an alkylene oxide chain starting group, can have as a starting nucleus almost any active hydrogen containing group including, without limitation, amides, phenols, and secondary alcohols. Such nonionic surfactants are presently commercially available from BASF AG (Ludwigshafen, Germany) as well as from BASF Corp. (Mt. Olive Township, N.J.) as PLURONICS® surfactants, as well as in the POLYTERGENT® E, and POLYTERGENT® P series of materials from Olin Chemicals Corp., (Stamford Conn.) which are described to be nonionic surfactants based on ethoxy/propoxy block copolymers.

Amphoteric detergents may also be used, including the salts of higher alkyl beta-amino propionic acids, e.g., sodium N-lauryl beta-alanine; the higher alkyl substituted betaines, such as lauryl dimethylammonium acetic acid; and the imidazoline type of amphoteric detergents.

Exemplary betaine surfactants include one or more water-soluble betaine surfactants which may be represented by the general formula:

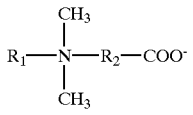

wherein $R_1$ is an alkyl group containing from 8 to 18 carbon atoms, or the amido radical which may be represented by the following general formula:

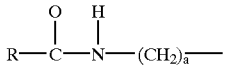

wherein R is an alkyl group having from 8 to 18 carbon atoms, a is an integer having a value of from 1 to 4 inclusive, and $R_2$ is a $C_1$–$C_4$ alkylene group. Examples of such water-soluble betaine surfactants include dodecyl dimethyl betaine, as well as cocoamidopropylbetaine.

Exemplary cationic surfactants include both short chain alkyl, and long chain alkyl quaternary ammonium compounds. The former of these are typically associated with providing a germicidal or sanitizing benefit to the compositions of which they form a part.

Exemplary cationic surfactants based on short chain alkyl quaternary ammonium compounds include quaternary ammonium compounds and salts thereof which may be characterized by the general structural formula:

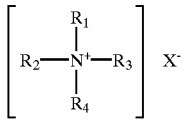

where at least one or $R_1$, $R_2$, $R_3$ and R4 is a alkyl, aryl or alkylaryl substituent of from 6 to 26 carbon atoms, and desirably the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Exemplary counterions include halides, for example chloride, bromide or iodide, or methosulfate.

Preferably the inventive compositions include least one nonionic surfactant. Exemplary nonionic surfactants include the polyoxyethylene ethers of alkyl aromatic hydroxy compounds, e.g., the alkylated polyoxyethylene phenols, the polyoxyethylene ethers of long chain aliphatic alcohols, the polyoxyethylene ethers of hydrophobic propylene oxide polymers. Desirably the nonionic surfactants are one or more alcohol ethoxylates. Particularly useful are alcohol ethoxylates in the Genapol® "26-L" series which include $C_{12}$–$C_{16}$ linear alcohols condensed with varying amounts of ethylene oxide. Exemplary are those in the Genapol® "26-L" series which include for example: $C_{12-16}$ linear alcohols condensed with 1 mole of ethylene oxide (Genapol® 24-L-3); $C_{12-16}$ linear alcohols condensed with 1.6 moles of ethylene oxide (Genapol® 26-L-1.6); $C_{12-16}$ linear alcohols condensed with 2 moles of ethylene oxide (Genapol® 26-L-2); $C_{12-16}$ linear alcohols condensed with 3 moles of ethylene oxide (Genapol® 26-L-3); $C_{12-16}$ linear alcohols condensed with 5 moles of ethylene oxide (Genapol® 26-L-5); as well $C_{12-16}$ linear alcohols condensed with varying amounts of ethylene oxide to provide specific cloud points of the surfactant (i.e., Genapol® 26-L-60, Genapol® 26-L-60N, and Genapol® 26-L-98N). These materials are commercially available from a variety of sources, including Clariant Corp. (Charlotte, N.C.).Particularly useful are those which are described in the Examples.

Desirably at least two different detersive surfactants are present, as mixtures of different surfactants are expected to provided a broader range of detergency. When the preferred linear alcohol ethoxylates are used, it is preferred that two (or more) be present, and that there be at least a 50% difference in the average moles of ethoxylation between these two. For example, where a first alcohol ethoxylate is used having an average of 4 moles of ethoxylation, then it is preferred that the second alcohol ethoxylate present have an average of at least 6 moles of ethoxylation.

The inventors have also found that the relative amounts of the preferred nonionic linear alcohol ethoxylates plays a contributing part to the ultimate viscosity of the formulation. Desirably, when two linear alcohol ethoxylates are used, and they exhibit at least a 50% difference in the average moles of ethoxylation, the respective weight ratios of the linear alcohol ethoxylate with the higher degree of ethoxylation to the linear alcohol ethoxylate with the lower degree should be within the respective ranges as exemplified by the Examples described below.

Desirably the detersive surfactant consists solely of one or more, especially two or more nonionic surfactants.

The detersive surfactant is present in amounts of from 0.001–25% wt. based on the total weight of the composition. Desirably the detersive surfactant is present in an amount of from 0.1–16% wt., more preferably from 1–12% wt.

The compositions of the invention also include at least one organic solvent, preferably at least one organic solvent selected from alcohols, diols, glycols, glycol ethers, $C_6$–$C_{18}$ methyl ester as well as pyrrolidone compounds such as N-methylyrrolidone and similar compounds having a lactam moiety, including N-methyl-2-pyrrolidone. Useful organic solvents are those which are at least partially water-miscible such as alcohols (such as ethanol, n-propanol, isopropanol, the various isomers of butanol, etc.), diols, glycols (such as propylene glycol, hexylene glycol, etc.) water-miscible ethers (e.g. diethylene glycol diethylether, diethylene glycol dimethylether, propylene glycol dimethylether), water-miscible glycol ethers (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethyleneglycol or propylene glycol (e.g. propylene glycol monomethyl ether acetate) all commercially available from Union Carbide, Dow Chemicals or Höchst. Also useful are $C_6$–$C_{18}$ methyl esters (such as methyl caprylate-caprate, methyl laurate and methyl oleate; such as EMERY® and EMEREST® methyl esters, ex. Henkel) as well as N-methyl-2-pyrrolidone. Mixtures of organic solvents can also be used. Particularly preferred are the organic solvents illustrated in the Examples.

The organic solvent is present in amounts of from 0.001–20% wt. based on the total weight of the composition. Desirably the organic solvent is present in lesser amounts, desirably from 0.1–15% wt., more desirably from 1–15% wt.

The compositions include an enzyme constituent which includes one or more enzymes which are effective in the breakdown of certain stains and soils. Preferably the enzyme constituent includes proteases which are known to be effective in the breakdown of protein based stains, such as blood, mucus, grass, egg and gravy. Protein based stains are known to be particularly difficult to remove, but in the presence of an effective protease, they are hydrolized into peptides and may be more readily removed in a subsequent laundering step. Enzymes which are contemplated as useful include lipases, amylases, peroxidases, pectinases and the like. Combinations of two or more different enzymes may also be present, but it is preferred that at least proteases be present.

The enzyme constituent need be present in an effective amount. It will be recognized by skilled practitioners that the activity of the enzymes in a commercially available preparation may vary, and that such activity is very relevant in determining the amount of the commercially available preparation to be used in the inventive composition. Thus, one skilled in the art may determine by means of a few routine experiments what amount of a commercially available enzyme preparation is to be included in the inventive compositions. By way of non-limiting example, one commercially available preparation, SAVINASE (ex. Novo Nordisk) is a protease based preparation which is advantageously present in amounts of from 0.001–5% wt. based on the total weight of the composition. Desirably, lesser amounts need be present, such as from 0.001–1% wt. Particularly preferred amounts are demonstrated in the Examples.

The inventive compositions include a xanthan gum as the primary thickener constituent. More specifically the inventive compositions do not include other thickeners based on acrylic polymers, or naturally occurring or synthetic clay thickeners. The inventors have surprisingly found that the inventive compositions provides two unique benefits. First, the use of xanthan gum as the thickener provides the beneficial viscosity characteristics which allows for the use of the same composition in both hand pumpable trigger spray dispensers, as well as in nozzled dispensers. Second, the use of xanthan gum as the thickener also provides improved cleaning of stains, as opposed to similar compositions which substitute either an acrylic polymer or synthetic clay thickener in the place of the xanthan gum.

The xanthan gum typically needs to be present in only minor amount in order to provide a satisfactory thickening effect to the inventive composition. It is to be understood that the actual amount will vary on the ultimate viscosity characteristics which are desired, but advantageously amounts of from 0.001–10% wt. based on the total weight of the composition are considered to be generally effective. More desirably, the xanthan gum is present in lesser amounts, desirably from 0.01–8% wt. Of course higher amounts may be used where a thicker formulation is desired.

As is noted above, the compositions according to the invention are aqueous in nature. Water is added in order to provide to 100% by weight of the compositions of the invention. The water may be tap water, but is preferably distilled or soft water, and is most preferably soft water or deionized water. The inventive compositions desirably include at least 70% wt. water, more desirably include at least 80% wt. water.

Compositions of the invention may also include one or more optional constituents including, but not limited to: pH adjusting agents, pH buffering agents, chelating agents, hydrotropes, perfumes, perfume carriers, fluorescing agents, optical brighteners, colorants such as dyes, hydrotropes, enzyme stabilizers, builders, germicides, fungicides, preservative constituents, anti-oxidants, anti-corrosion agents, antistatic agents as well as other conventional additives known to the relevant art.

In certain particularly preferred embodiments, borax is included as an effective pH buffering constituent (ex. U.S. Borax Co.). This constituent is preferred for use as the buffer as it is believed to contribute to stabilizing the enzyme constituent in the aqueous compositions. Others however can be used as well, such as the citrates, citric acid, and the like.

In certain embodiments of the invention, one or more builders are included in the compositions. These detergency builders, of the organic or inorganic type. include water soluble inorganic builders which can be used alone, in admixture with other water soluble inorganic builders, as well as in conjunction with one or more organic alkaline sequestrant builder salt.

Exemplary detergency builders include alkali metal carbonates, phosphates, polyphosphates and silicates. More specific examples include sodium tripolyphosphate, sodium carbonate, potassium carbonate, sodium polyphosphate, potassium pyrophosphate, potassium tripolyphosphate, and sodium hexametaphosphate.

Exemplary organic alkaline sequestrant builder salts include alkali metal polycarboxylates including water-soluble citrates such as sodium and potassium citrate, sodium and potassium tartarate, sodium and potassium ethylenediaminetetraacetate, sodium and potassium N-(2-hydroxyethyl)-ethylene diamine triacetates, sodium and potassium nitrilo triacetates, as well as sodium and potassium tartrate mono- and di-succinates. As noted, these organic builder salts may be used individually, as a combination of two or more organic builder salts, as well as in conjunction with one or more detergency builders, including those indicated above.

In certain particularly preferred embodiments, a minor but an effective amount of a biocidal composition, which acts as a preservative, is also included. One such material is DOWICIL 75 (ex. Dow Chem. Co.) Others may be used as well, as long as they do not deleteriously effect the other constituents, especially the enzyme constituent.

Such constituents as described above as essential and/or optional constituents are per se, known to the art.

According to preferred embodiments, the compositions of the invention exhibit a viscosity in the range of from about 15,000 to about 62,000 centipoise when measured on a Brookfield viscometer, using a #2 spindle; 0.3 rpm, 75° F. (23.8° C.). Preferably the compositions exhibit a viscosity from about 20,000 to about 35,000 at these test conditions.

The compositions of the invention can be prepared in a conventional manner such as by simply mixing the constituents in order to form the ultimate aqueous cleaning composition. The order of addition is not critical, but it may be convenient to form a premixture of the organic solvents and the detersive surfactants at an elevated temperature, and to subsequently blend these into the remaining constituents which are dispersed in water. Conveniently, the xanthan gum is added as the last constituent.

The compositions of this invention may be packaged in any suitable container, such as an unpressurized bottle or in a pressurized container. They may be pressurized and made available in this form by means of the addition of a suitable propellant to the composition such as known hydrocarbon propellants including propane, butane, isobutane, and isopentane, halogenated hydrocarbon propellants including chlorodifluoromethane, difluoroethane dichlorodifluoromethane as well as pressurized gases such as carbon dioxide and nitrogen. Most desirably, the compositions are packaged and provided in a container especially a pressurized vessel or a manually operable pump which induces foaming of the composition as it is dispensed from the container.

Substrates which can be treated in accordance with this invention are textile fibers or filaments, and finished or fabricated fibrous articles such as textiles, and garments. The textiles include those made of natural fibers, such as cotton and wool, as well as those made of synthetic organic fibers, such as nylon, polyolefin, acetate, rayon, acrylic and polyester fibers.

The following examples illustrate the superior properties of the formulations of the invention and particular preferred embodiments of the inventive compositions. The terms "parts by weight" or "percentage weight" as well as "% wt." are used interchangeably in the specification and in the following Examples wherein the weight percentages of each of the individual constituents are indicated in weight percent based on the total weight of the composition, unless indicated otherwise.

EXAMPLES

Illustrative exemplary formulations within the scope of the present inventive compositions are provided on Table 1 below, which are designated as "Example" or "Ex." formulations. Comparative examples are indicated as "C" formulations on Table 1.

TABLE 1

| | Ex. 1 | Ex. 2 | Ex. 3 | Ex. 4 | Ex. 5 | Ex. 6 |
|---|---|---|---|---|---|---|
| Genapol 26-L-60 | 4.5 | 5.0 | 5.5 | 9.0 | 9.0 | 3.1 |
| Genapol 26-L-3 | 5.5 | 5.0 | 4.5 | 1.0 | 1.0 | 4.9 |
| propylene glycol | 7.0 | 7.0 | 7.0 | 7.0 | 7.0 | 8.0 |
| Borax 10 mole | 0.51 | 0.51 | 0.51 | 0.51 | 0.51 | 0.51 |
| Dowicil 75 | 0.05 | 0.05 | 0.05 | 0.05 | 0.05 | 0.05 |
| Kelzan ST | — | — | — | — | — | 0.30 |
| Keltrol T | 0.30 | 0.30 | 0.30 | 0.40 | 0.70 | — |
| Savinase 16.0L | 0.41 | 0.41 | 0.41 | 0.41 | 0.41 | 0.41 |
| Fragrance | 0.1 | 0.1 | 0.1 | 0.1 | 0.1 | 0.1 |
| di water | to 100 | 10 100 | to 100 | to 100 | to 100 | to 100 |

| | C1 | C2 | C3 | C4 | C5 | C6 | C7 | C8 |
|---|---|---|---|---|---|---|---|---|
| Genapol 26-L-60 | 4.5 | 5.0 | 5.5 | 9.0 | 3.1 | 9.0 | 4.5 | 5.5 |
| Genapol 26-L-3 | 5.5 | 5.0 | 4.5 | 6.0 | 4.9 | 1.0 | 5.5 | 4.5 |
| propylene glycol | 7.0 | 7.0 | 7.0 | 7.0 | 8.0 | 7.0 | 7.0 | 7.0 |
| Borax 10 mole | 0.51 | 0.51 | 0.51 | 0.51 | 0.51 | 0.51 | 0.51 | 0.51 |
| Dowicil 75 | 0.05 | 0.05 | 0.05 | 0.05 | 0.05 | 0.05 | 0.05 | 0.05 |
| Laponite Clay | 0.4 | 0.4 | 0.4 | — | — | — | — | — |
| Carbopol 2623 | — | — | — | 0.58 | 0.15 | — | — | — |
| Acusol 820 | — | — | — | — | — | 0.2 | 0.4 | 0.4 |
| Savinase 16.0L | 0.41 | 0.41 | 0.41 | 0.41 | 0.41 | 0.41 | 0.41 | 0.42 |
| Fragrance | 0.1 | 0.1 | 0.1 | 0.1 | 0.1 | 1.0 | 1.0 | 1.0 |
| di water | to 100 | 10 100 | to 100 | to 100 | to 100 | to 100 | to 100 | to 100 |

It is to be understood that the amount of the constituents are listed above are "as is" weights as supplied by the respective supplier. The identity of the individual constituents described in Table 1 above, their percentage by weight 'actives', as well as presently available commercial sources, are described in more detail in Table 2, below.

TABLE 2

| | |
|---|---|
| Genapol 26-L-60 | alcohol ethoxylate (100% wt) (Clariant Corp.) |
| Genapol 26-L-3 | alcohol ethoxylate (100% wt) (Clariant Corp.) |
| propylene glycol | propylene glycol (100% wt.) (Dow Chem. Co.) |
| Borax 10 mole | borax (U.S. Borax Co.) |
| Dowicil 75 | preservative (Dow Chem. Co.) |
| Acusol 820 | acrylate based thickener (30% wt. active) (Rohm & Haas Co.) |
| Laponite RD Clay | clay based thickener (Southern Clay Products) |
| Carbopol 2623 | acrylate based thickener (30% wt.) (B. F. Goodrich) |
| Kelzan ST | xanthan gum based thickener (supplied at 100%, but dispersed in water to form a 1% wt. dispersion) (Kelco Co.) |
| Keltrol T | xanthan gum based thickener (supplied at 100%, but dispersed in water to form a 1% wt. dispersion) (Kelco Co.) |
| Fragrance | proprietary |
| Savinase 16.0L | protease containing, enzyme preparation (16 KNPU/gram according to Novo Nordisk test protocol for proteolytic activity) (Novo Nordisk Inc.) |
| di water | deionized water |

The viscosity of certain of the compositions described on Table 1 were evaluated using a Brookfield viscometer, with a #2 spindle and a rotational speed of 0.3 rpm. The test was carried out at 75° F. (23.8° C.). All of the samples were evaluated 'as mixed'. The results of this test are illustrated on Table 3, below:

TABLE 3

| | Ex. 1 | Ex. 2 | Ex. 3 | Ex. 4 | Ex. 5 | Ex. 6 |
|---|---|---|---|---|---|---|
| viscosity, centipoise (#2 spindle; 0.3 rpm, 75° F.) | 55,000 | 35,000 | 30,000 | 20,000 | 60,000 | 28,000 |
| viscosity, centipoise (#2 spindle; 3 rpm, 75° F.) | 7870 | 6280 | 5890 | 4160 | EEEE | 4430 |

| | C1 | C2 | C3 | C4 | C5 | C6 | C7 | C8 | SHOUT ® |
|---|---|---|---|---|---|---|---|---|---|
| viscosity, centipoise (#2 spindle; 0.3 rpm, 75° F.) | 15,000 | 10,000 | 6600 | 1000 | 67,700 | 700 | 1700 | 5000 | 83,500 |
| viscosity, centipoise (#2 spindle; 3 rpm, 75° F.) | 2300 | 1700 | 1690 | — | — | 140 | 1470 | 1420 | 9630 |

'EEEE' indicated that the viscosity was higher than appropriate for the test conditions (spindle, rpm, temperature).
'—' indicates not tested, the identity of SHOUT ® is described below Spot Cleaning Testing Certain of the formulations described above were tested in order to evaluate their spot cleaning performance on stained textile swatches. This evaluation was in accordance with the protocol outlined in ASTM D-4265 (Reapproved 1998), using the standardized 'bandy black clay' as the test soil. This test soil and its source is defined in the protocol.

In the test, there were used test substrates of which unbleached cotton which did not have any surface treatment such as sizing, etc. These were obtained from Test Fabric Co. and are known standardized test swatches. For each formulation tested, there were six swatches used, each of which was treated as follows. To each of the swatches were applied five different stains, namely grape juice, bandy black clay, used motor oil, spaghetti sauce (RAGU®, Old World with Meat) and grass stains. The swatches were prepared in accordance with ASTM D-4265. The stains were allowed to dry. Subsequently, on each stain was used an aliquot of 2 ml. of a formulation to be evaluated, lightly rubbed three times from the reverse side of the swatch to distribute the forulation, and within 1 minute were introduced into a washing machine. The washing bath contained 85 grams of a commercially available laundry detergent (TIDE®, ex. Procter & Gamble Co.) and washed for 12 minutes, at a wash bath temperature of 90° F. (32.2° C.), followed by a cold water rinse, and spun to remove excess water. The laundered swatches were then removed, tumble dried in an domestic clothes dryer after which they were removed and SRI values evaluated as described below.

Due to the very poor viscosity characteristics of formulations containing laponite clays, these were not tested for stain removal performance.

For both of the tested formulations, solids removal, viz., stain removal from the various soils was assessed quantitatively using a Hunter Lab colorimeter, which measured each of the following values: the lightness ("$L_c$") of the unstained swatch; the lightness of the stained and subsequently washed swatch ("$L_w$"); redness-greenness of the unstained swatch ("$a_c$"), redness-greenness of the stained and subsequently washed swatch ("$a_w$"), yellowness-blueness of the unstained ("$b_c$") swatch, and yellowness-blueness of the stained and subsequently washed swatch ("$b_w$"); each of these values measured as the amount of the standardized white light reflected from the fabrics. The quantitatively evaluated values were measured for the various tested fabric swatches and were used to calculate the Stain Removal Index (SRI) according to the equation:

$$SRI=100-[(L_c-L_w)^2+(a_c-a_w)^2+(b_c-b_w)^2]^{1/2}$$

and the results are reported on Table 4, below. Therein are reported the average values of the six stained swatches for each stain per formulation tested. The SRI value ranges from 0 to 100, with a value of 100 indicating complete soil removal.

TABLE 4

| | grape juice | bandy black clay | used motor oil | spaghetti sauce | grass |
|---|---|---|---|---|---|
| Ex. 1 | 88.34 | 81.43 | 85.50 | 93.12 | 94.17 |
| Ex. 3 | 88.68 | 92.42 | 85.28 | 92.63 | 94.39 |
| Ex. 5 | 89.16 | 92.33 | 83.48 | 94.06 | 93.85 |
| C4 | 89.07 | 80.64 | 84.39 | 93.99 | 94.29 |
| C7 | 88.34 | 81.43 | 85.50 | 93.12 | 94.17 |
| Spray n' Wash ® | 88.39 | 84.19 | 85.66 | 93.34 | 92.43 |
| SHOUT ® 'push-pull' formulation | 88.34 | 92.04 | 85.31 | 94.96 | 94.59 |

As can be seen from the results reported on Table 4 the reported SRI values indicate excellent stain removal performance of the inventive compositions, particularly with respect to removal of bandy black clay. Surprisingly, these results demonstrate that the inventive compositions demonstrate better removal of bandy black clay than similar compositions which substitute either an acrylic polymer or synthetic clay thickener in the place of the xanthan gum.

Table 4 also reports the stain cleaning performance of two presently commercially available spot-cleaning compositions, "Spray n'Wash®" (ex Dowbrands Inc.), and SHOUT® Laundry Stain Remover in a nozzled 'push-pull' bottle (ex S. C. Johnson & Son.) which indicates improved or comparable performance with these commercial products.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

What is claimed is:

1. A thickened aqueous cleaning composition useful in the spot cleaning of stains and soils on garments and textiles, said composition consisting of the following constituents:

a detersive surfactant selected from anionic, nonionic, surfactants and mixtures thereof;

an organic solvent;

an enzyme;

a xanthan gum as the primary thickener constituent;

sufficient water to attain 100%; and optionally one or more further constituents selected from the group consisting of: pH adjusting agents; pH buffering agents; chelating agents; hydrotropes; perfumes; perfume carriers; fluorescing agents; optical brighteners; colorants; dyes; enzyme stabilizers; builders selected from the group consisting of alkali metal carbonates, phosphates, polyphosphates, silicates and polycarboxylates; germicides; fungicides; preservatives; anti-oxidants; anti-corrosion agents; and anti-static agents.

2. A thickened composition according to claim 1 wherein the detersive surfactant includes at least one linear alcohol ethoxylate.

3. A thickened composition according to claim 2 wherein the detersive surfactant includes at least two linear alcohol ethoxylates.

4. A thickened composition according to claim 3 wherein there is present at least a 50% difference in the average moles of ethoxylation between at least two of the linear alcohol ethoxylates present in the composition.

5. A thickened composition according to claim 1 wherein the composition exhibits a viscosity of from about 15,000 to about 62,000 centipoise when measured on a Brookfield viscometer, using a #2 spindle at 0.3 rpm, 75° F. (23.8° C.).

6. A thickened composition according to claim 1 wherein the organic solvent is selected from the group consisting of alcohols, diols, glycols and glycol ethers.

7. A thickened composition according to claim 6 wherein the organic solvent consists solely of propylene glycol.

8. A thickened composition according to claim 1 wherein the enzyme constituent comprises a protease.

9. A thickened composition according to claim 1 wherein:

the detersive surfactant comprises 0.001–25% wt. of the composition;

the organic solvent comprises 0.001–20% wt. of the composition; and the xanthan gum comprises 0.001–10% wt. of the composition.

10. A thickened composition according to claim 9 wherein the detersive surfactant comprises 0.1–16% wt. of the composition.

11. A thickened composition according to claim 10 wherein the detersive surfactant comprises 1–12% wt. of the composition.

12. A process for the localized cleaning of a soiled or stained garment or textile which process comprises the step of applying to a soiled or stained area a cleaning effective amount of a thickened aqueous composition consisting of:

a detersive surfactant selected from anionic, nonionic, cationic, amphoteric and zwitterionic surfactants and mixtures thereof;

an organic solvent;

an enzyme;

a xanthan gum as the primary thickener constituent;

sufficient water to attain 100%; and optionally one or more further constituents selected from the group consisting of: pH adjusting agents; pH buffering agents; chelating agents; hydrotropes; perfumes; perfume carriers; fluorescing agents; optical brighteners; colorants; dyes; enzyme stabilizers; builders selected from the group consisting of alkali metal carbonates, phosphates, polyphosphates, silicates and polycarboxylates; germicides; fungicides; preservatives; anti-oxidants; anti-corrosion agents; and anti-static agents.

13. A process according to claim 12 in which the solvent is selected from the group consisting of alcohols, diols, glycols, glycol ethers and mixtures thereof.

14. A process according to claim 13 in which the solvent is propylene glycol.

15. A process according to claim 12 in which the composition comprises at least 70 wt. % water.

16. A process according to claim 12 in which the derisive surfactant includes at lease two linear alcohol ethoxylates wherein there is at least a 50% difference in the average moles of ethoxylation between two of said ethoxylates.

17. A thickened aqueous cleaning composition which consists of the following constituents:

as the only detersive surfactants present in the composition, one or more surfactants selected from anionic surfactants and nonionic surfactants;

as the only organic solvents present in the composition, one or more organic solvents selected from alcohols, diols, glycols and glycol ethers;

an enzyme;

a xanthan gum as the primary thickener constituent;

at least 70% wt. water; and optionally one or more further constituents selected from the group consisting of: pH adjusting agents; pH buffering agents; chelating agents; hydrotropes; perfumes; perfume carriers; fluorescing agents; optical brighteners; colorants; dyes; enzyme stabilizers; builders selected from the group consisting of alkali metal carbonates, phosphates, polyphosphates, silicates and polycarboxylates; germicides; fungicides; preservatives; anti-oxidants; anti-corrosion agents; and anti-static agents.

18. A thickened composition according to claim 17 wherein the detersive surfactant includes at least two linear alcohol ethoxylates.

19. A thickened composition according to claim 18 wherein there is present at least a 50% difference in the average moles of ethoxylation between at least two of the linear alcohol ethoxylates present in the composition.

20. A thickened composition according to claim 17 wherein the organic solvent consists solely of propylene glycol.

21. A thickened composition according to claim 17 wherein the enzyme constituent comprises a protease.

22. A thickened composition according to claim 21 wherein the protease enzyme comprises 0.001–5% wt. of the composition.

23. A thickened composition according to claim 17 wherein the composition exhibits a viscosity of from about 15,000 to about 62,000 centipoise when measured on a Brookfield viscometer, using a #2 spindle at 0.3 rpm, 75° F. (23.8° C.).

24. A process for the spot cleaning of stains and soils on garments and textiles which process comprises the steps of: providing a thickened aqueous cleaning composition consisting of:

a detersive surfactant selected from anionic, nonionic, cationic, amphoteric and zwitterionic surfactants and mixtures thereof;

an organic solvent;

an enzyme;

a xanthan gum as the primary thickener constituent;

sufficient water to attain 100%; and optionally one or more further constituents selected from the group consisting of: pH adjusting agents; pH buffering agents; chelating agents; hydrotropes; perfumes; perfume carriers; fluorescing agents; optical brighteners; colorants; dyes; enzyme stabilizers; builders selected from the group consisting of alkali metal carbonates, phosphates, polyphosphates, silicates and polycarboxylates; germicides; fungicides; preservatives; anti-oxidants; anti-corrosion agents; and anti-static agents; and applying a cleaning effective amount of said composition to the soiled or stained area of a garment or textile.

25. The process of claim 24 which includes the further step of laundering the garment or textile after applying the cleaning composition thereto.

26. A thickened aqueous cleaning composition useful in the spot cleaning of stains and soils on garments and textiles, said composition comprising the following constituents:

a detersive surfactant substituent selected from anionic, nonionic, cationic, amphoteric and zwitterionic surfactants and mixtures thereof, said substituent comprising at least two linear alcohol ethoxylates having at least a 50% difference in their average moles of ethoxylation;

an organic solvent;

an enzyme;

a xanthan gum as the primary thickener constituent;

at least 70% wt. water; and optionally one or more further constituents selected from the group consisting of pH adjusting agents, pH buffering agents, chelating agents, hydrotropes, perfumes, perfume carriers, fluorescing agents, optical brighteners, colorants, dyes, enzyme stabilizers, builders, germicides, fungicides, preservatives, anti-oxidants, anti-corrosion agents and antistatic agents.

* * * * *